US005306009A

United States Patent [19]

Bolanos

[11] Patent Number: 5,306,009

[45] Date of Patent: Apr. 26, 1994

[54] GOLF PRACTICE KIT

[76] Inventor: Antonio R. Bolanos, 9024C2 Fishers Pond Dr., Charlotte, N.C. 28277

[21] Appl. No.: 954,818

[22] Filed: Oct. 1, 1992

[51] Int. Cl.[5] ..... A63B 69/36

[52] U.S. Cl. ..... 273/181 F; 273/182 R; 273/181 D; 273/181 J

[58] Field of Search ..... 273/176.11, 181, 182, 273/35 B, 32 R, 35 R

[56] References Cited

U.S. PATENT DOCUMENTS

| | | | |
|---|---|---|---|
| 1,204,645 | 11/1916 | Boardman | 273/181 R |
| 1,258,241 | 3/1918 | Porte | 273/182 R |
| 2,011,146 | 8/1935 | Evans | 273/176 K |
| 2,232,569 | 2/1941 | Johnson | 273/182 R |
| 3,420,528 | 1/1969 | Day | 273/182 R |
| 3,910,583 | 10/1975 | Appel et al. | 273/182 A |
| 5,018,731 | 5/1991 | Doyle | 273/181 F |
| 5,102,141 | 4/1992 | Jordan | 273/179 R |

FOREIGN PATENT DOCUMENTS

| | | | |
|---|---|---|---|
| 8502549 | 6/1985 | PCT Int'l Appl. | 273/182 A |

*Primary Examiner*—Mark S. Graham
*Attorney, Agent, or Firm*—Clifton Ted Hunt

[57] ABSTRACT

The golf practice kit of this invention utilizes a canvas ramp including a curved upper portion and an inclined target portion that slopes upwardly and away from the tee where the user stands. The kit is designed for practice with all of the golf clubs except the putter. For this purpose, the inclined target portion has a lower target area for the use of woods, a mid target area for practice with the long irons (2–6), and an upper target area for practice with the short irons (7–9).

Above the upper target area, the curved upper portion of the ramp curves inwardly on itself to define an arc of more than 360° and terminates in a laterally sloping trough. The velocity of a ball hit against any of the target areas carries the ball into the arc at the top of the ramp where the ball's kinetic energy is expended, causing the ball to drop into the laterally sloping trough, which delivers it, by gravity, to a ball return conduit formed of fabric and extending between the lower end of the trough and a receptacle at the tee area.

The receptacle is structured to orient successive balls for retrieval by simply inserting the head of the user's golf club in the receptacle.

The ramp is supported by a tubular frame that can be easily assembled and disassembled by the user. The frame also supports safety netting on both sides of the ramp.

11 Claims, 4 Drawing Sheets

GOLF PRACTICE KIT

FIELD OF THE INVENTION

The golf practice kit uses a foldable and portable flexible barrier to arrest the flight of the ball during practice, and a conduit for returning the arrested ball from the barrier to the user.

BACKGROUND OF THE INVENTION

The use of foldable and portable flexible barriers to arrest the flight of golf balls hit in practice is well known. The structure and configuration of the barriers varies widely, as shown in the disclosures of the following patents which are considered exemplary of the prior art:

| U.S. Pat. No. | ISSUE DATE | INVENTOR | TITLE |
|---|---|---|---|
| 1,173,262 | Feb 29, 1916 | Gunzburg | APPARATUS FOR USE IN PRACTICING THE GAME OF GOLF |
| 1,218,390 | Mar 6, 1917 | Gates | PRACTICE DEVICE FOR GOLF AND LIKE OUTDOOR GAMES |
| 1,669,640 | May 15, 1928 | Warlick | INDOOR GOLF |
| 3,390,882 | July 2, 1968 | Megerle | PORTABLE GOLF DRIVING RANGE INCLUDING HINGE MEANS CONNECTING SELF-SUPPORTING PANELS |
| 3,643,959 | Feb 22, 1972 | Cornell | GOLF GAME |
| 3,895,809 | July 22, 1975 | Shockley | BALL RETURN DEVICE |
| 4,381,110 | Apr 26, 1983 | Balaz | GOLF TRAINER DEVICE |
| 4,556,219 | Dec 3, 1985 | Tillery | GOLF PRACTICE CAGE |
| 4,703,931 | Nov 3, 1987 | Steen | APPARATUS FOR RETURNING OR REBOUNDING A BALL |
| 4,883,272 | Nov 28, 1989 | Lay | BALL CATCHING MACHINE WITH BALL EXPELLING MACHINE CONNECTED THERETO |
| 4,969,651 | Nov 13, 1990 | Comartin | FLEXIBLE PROJECTILE ARRESTING DEVICE |
| 5,018,731 | May 28, 1991 | Doyle | GOLF BALL DRIVING PRACTICE APPARATUS |

Several of the foregoing patents rely on flexible netting to arrest the flight of the ball. See, for example, U.S. Pat. No. 4,381,110 to Balaz, U.S. Pat. No. 4,556,219 to Tillery, U.S. Pat. No. 4,703,931 to Steen, U.S. Pat. No. 4,883,272 to Lay, and U.S. Pat. No. 4,969,651 to Comartin.

The use of a stiffer fabric, such as canvas, to absorb the direct impact of the ball and thereby arrest its flight is shown in U.S. Pat. No. 1,218,390 to Gates, U.S. Pat. No. 3,895,809 to Shockley, and U.S. Pat. No. 5,018,731 to Doyle.

U.S. Pat. No. 1,173,262 to Gunzburg discloses a circular metal race. Gunzburg's race does not arrest the flight of the ball. Instead, the distance which a ball travels along the race, or the number of times the ball travels around the race is a measure of the length of the stroke.

The prior art discloses several ways to rely on the force of gravity to return the ball to the person practicing golf. Gravity causes the ball to stop at the bottom of Gunzburg's race, which is spaced a short distance from the entrance d of Gunzburg's funnel c. Gravity causes the ball to roll toward the user along the inclined lower wall 2 of Gates' sack; along the inclined lower wall 18 of Megerle's driving range; along the inclined lower wall 15 of the Balaz device; along the concave canvas member 24 of Shockley; along the inclined floor 22 of Tillery; along the inclined bottom wall 26 of Steen; and along the inclined return channel 82 of Doyle. Gravity directs the balls along the inclined pan 17 of Warlick and into the inclined return pipe 18 which empties into a box-like rack 19 on the tee.

Shockley and Doyle disclose target areas (28 and 56, respectively) that are substantially perpendicular to the path of the ball.

SUMMARY OF THE INVENTION

The head of a golf club follows an arc of a predictable radius each time a golfer swings a golf club to hit a ball. This radius is not always the same. The size of the radius is determined, mainly, by the length of the club and the height of the golfer.

The trajectory of the ball after impact depends primarily on the angle of the club head at the moment of impact. There is a zone that extends a very short distance from the point of impact through which the club head and the ball follow approximately the same trajectory (the common zone). After leaving the "common zone", the club head continues in its arc of a predictable radius and the ball proceeds along the trajectory determined by the angle of the club head at the moment of impact.

A barrier extending at an appropriate angle and spaced slightly beyond the "common zone" will be struck by the ball but will not be hit by the club head.

The golf practice kit of this invention utilizes these factors to provide a small scale enclosure that effectively permits full scale practice with all of the golf clubs, except the putter, within the golf practitioner's or user's living room, if desired.

The "barrier" is the target portion of a tensioned fabric ramp that slopes upwardly and away from the tee where the user stands to hit the ball. A tee area extends forwardly from the target portion to locate the ball a precise distance from the ramp. The location of the tee area and the initial position of the ball relative to the ramp is determined by the maximum distance a club head extends toward the ramp from the user during the golf stroke to be used in hitting the ball. The initial position of the ball is preferably spaced from the ramp just enough to prevent the club head from hitting the ramp, and no more. The reason for this spacing is to minimize the chance of the ball being accidentlly misdirected away from the ramp.

The inclined ramp has a lower target area for practice with woods, a target area in the mid-portion of the ramp for practice with the long irons (2–6), and an upper target area for practice with the short irons (7–9).

Above the upper target area, the ramp curves inwardly on itself to define an arc of more than 360° and terminates in a laterally sloping trough. The velocity of a ball hit against any of the target areas carries the ball into the arc at the top of the ramp where the ball's kinetic energy is expended, causing the ball to drop into the laterally sloping trough, which delivers it, by gravity, to a ball return conduit extending between the lower end of the trough and a receptacle at the tee area.

The receptacle is structured to receive a plurality of balls in alinement and to orient successive balls for retrieval by simply inserting the head of the user's golf club in the receptacle.

The ramp is supported by a tubular frame that can be easily assembled and disassembled by the user. The frame also supports safety netting on both sides of the ramp.

BRIEF DESCRIPTION OF THE DRAWINGS

FIG. 2A is a rear view of the front frame member, illustrating its attachment to the front of the ramp;

DETAILED DESCRIPTION OF THE INVENTION

Figure 1:
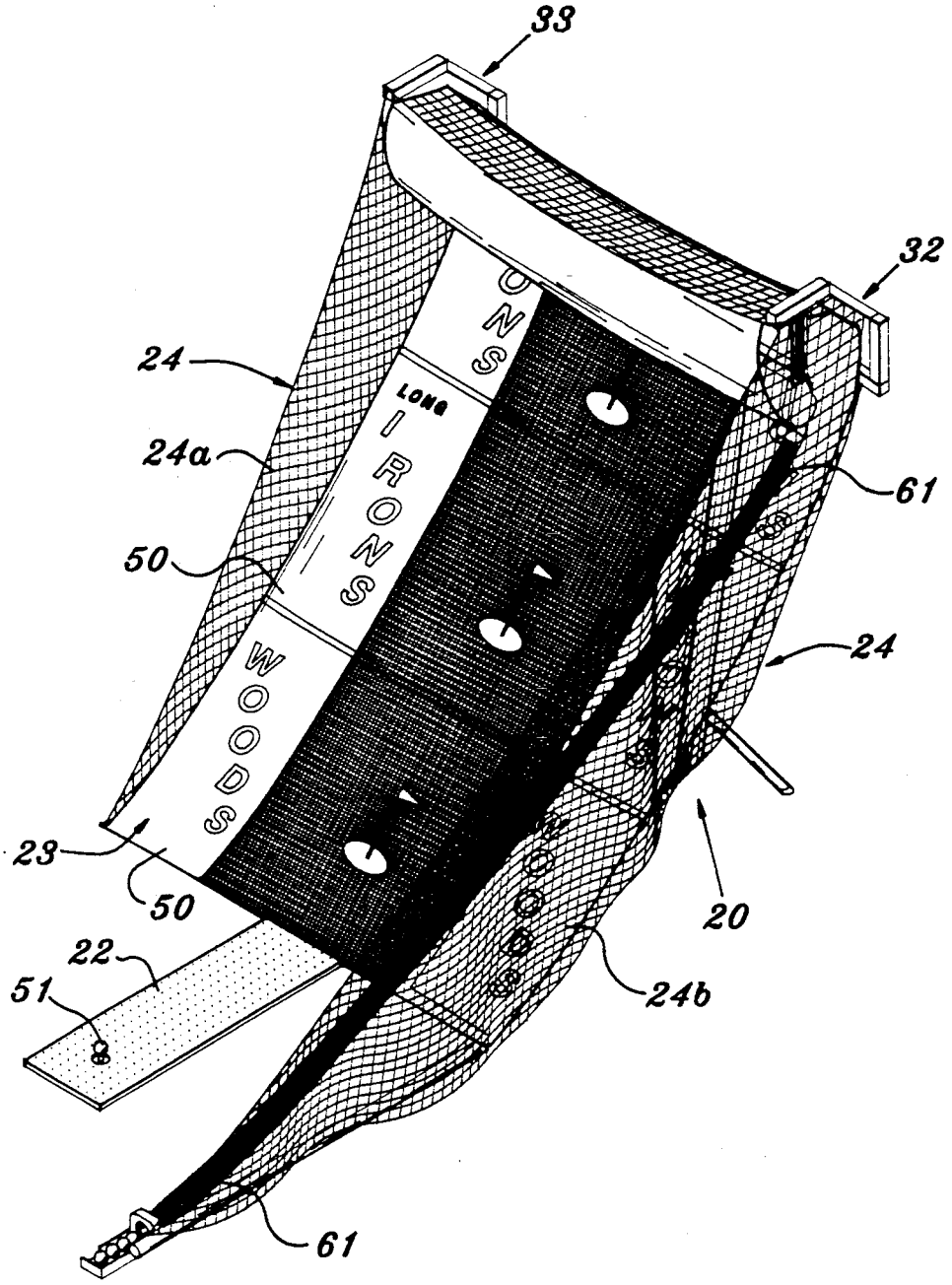
FIG. 1 is a perspective view showing the tee, target portion of the ramp, and safety netting of the golf practice kit.
Figure 2:
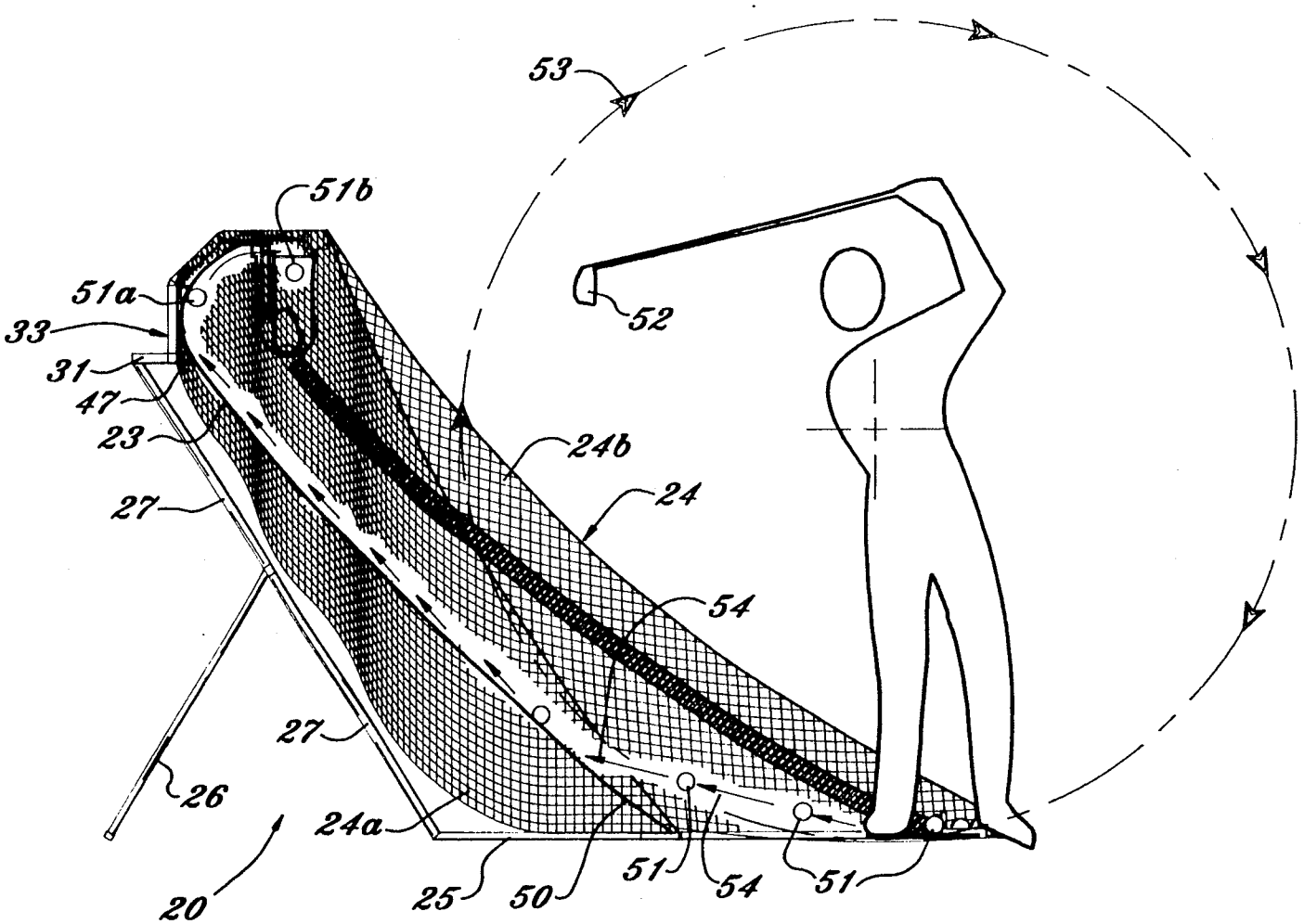
FIG. 2 is a side view of the kit showing the preferred position of a user with respect to the target portion of the ramp when addressing the ball, and showing the path of a ball along the ramp after being hit from the tee.

Referring more specifically to the drawings, the golf practice kit is broadly indicated at 20 in FIGS. 1 and 2. The kit 20 includes a metal frame, broadly indicated at 21 (FIG. 11), a tee 22, a ramp 23, and safety netting 24.

The metal frame 21 comprises a triangular base 25 angular (frame members 25A, 25B, and lower horizontal frame member 25C) at the front of the frame and rearwardly spaced legs 26. The base 25 and legs 26 rest on the floor or other supporting surface and support an upwardly inclined frame member 27 extending from the base 25 to a pair of top frame members 30 and 31 which diverge forwardly from their juncture with the inclined frame member 27 near the top of the ramp 23.

Figure 3:
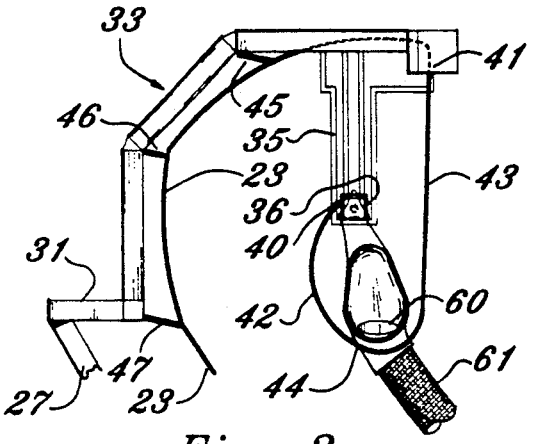
FIG. 3 is a side view similar to FIG. 2 but with parts broken away and showing only the curved upper portion of the ramp and associated parts.
Figure 4:
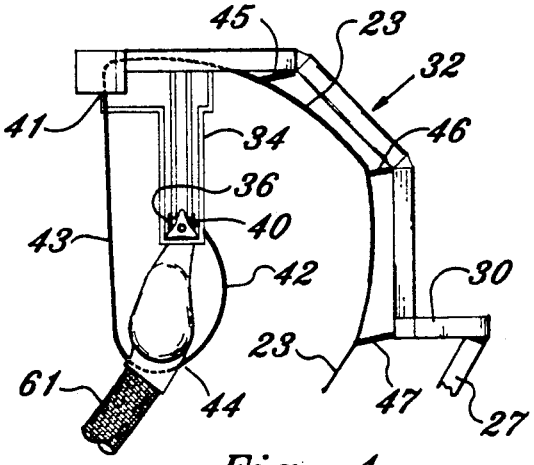
FIG. 4 is a side view of the curved upper portion of the ramp, with parts broken away, looking at the side opposite that shown in FIG. 3.
Figure 11:
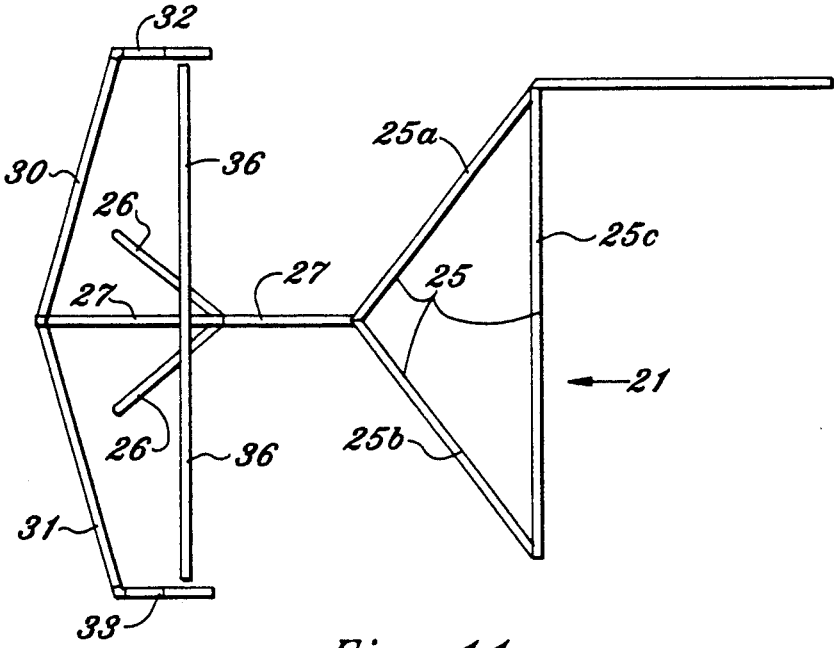
FIG. 11 is a top view of the assembled frame removed from the ramp and safety netting.

As most clearly seen in FIGS. 3, 4 and 11, generally C-shaped portions 32 and 33 of the frame 21 extend forwardly from the top frame members 30 and 31, respectively. Ears 34 and 35 extend downwardly from the free end of the C-shaped frame portions 32 and 33, respectively, and support in lieu thereof horizontal frame member 36.

The horizontal frame member 36 supports the upper end 40 of the ramp 23. The ramp 23 extends loosely from the horizontal frame member 36 to connections 41 with the free ends of the C-shaped frame portions 32 and 33. Between its connections with the horizontal frame member 36 and the C-shaped frame portions 32 and 33, the ramp extends first downwardly as at 42 and then upwardly as at 43 in FIGS. 3–6 to form a trough 44.

The ramp is additionally attached to the C-shaped frame portions 32 and 33 by angularly spaced elastic straps 45, 46, and 47. The ramp is tensioned to pull away from the metal frame 21 and the elastic straps hold the ramp in spaced relation to the frame to prevent balls from striking and dangerously bouncing from the metal frame.

As best seen in FIG. 2, the target portion 50 of the ramp 23 extends downwardly and forwardly in substantially a straight line and at approximately a 40° angle from its connection at 47 with the C-shaped portion of the frame to its attachment as at 48 (FIG. 2A) to the lower horizontal frame member 25C at the front of the frame 21.

In the illustrated embodiment, the highest part of the target portion 50 of the ramp 23 is about six feet above the floor and is divided into three areas. Separate targets are provided for practice with woods, with long irons, and with short irons, as shown in FIG. 1. More loft is required for practice with the irons, so the target for woods is placed at the bottom of the target portion 50 and the target for the short irons is placed at the top of the target portion 50.

The tee area 22 extends forwardly from the target portion 50 to locate the ball 51 a precise distance from the ramp 23. Referring to FIG. 2, the location of the tee area 22 and the initial position of the ball 51 relative to the ramp 23 is determined by the maximum distance a club head 52 extends toward the ramp from the user during the golf stroke (illustrated by the directional arrows 53 in FIG. 2) to be used in hitting the ball. The initial position of the ball 51 is preferably spaced from the ramp 23 just enough to prevent the club head from hitting the ramp, and no more. The reason for this spacing is to minimize the chance of the ball being accidentlly misdirected away from the ramp.

Additional security is provided by the safety netting 24, supported by the frame 21, on both sides of the ramp 23. In FIGS. 1 and 2, the safety net on the left side of the ramp is indicated at 24A and the safety net on the right side of the ramp is indicated at 24B. The net 24B on the right side of the ramp is shown to be larger than the net 24A and to extend forwardly beyond the ramp. This is the preferred arrangement for right handed golfers. For left handed golfers the arrangement would be reversed, placing the larger net 24B on the left side of the ramp and the smaller net 24A on the right side of the ramp.

Figure 5:
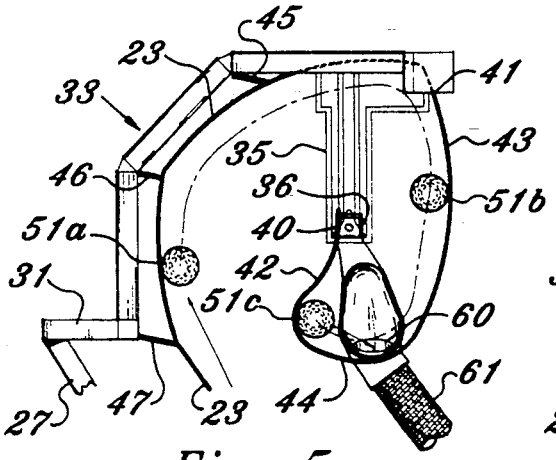
FIGS. 5 and 6 are side views similar to FIG. 3 illustrating the path of a ball along the curved upper portion of the ramp and into the trough as the kinetic energy of the ball is spent.
Figure 6:
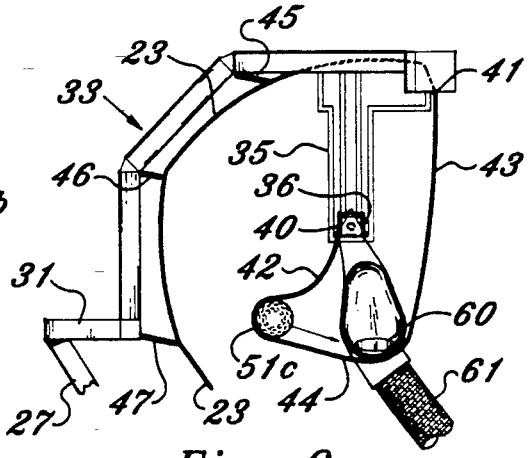

The path of the ball 51 after being struck is illustrated in FIGS. 2, 5, and 6 by directional arrows 54 and by the sequential positions of the ball 51. Using a wood, the ball 51 will initially strike the lower portion of the target area 50 and the impetus of the ball, coupled with the resilience of the tensioned canvas ramp, will cause the ball to move upwardly along the contour of the target portion 50 of the ramp 23.

When the ball 51 reaches the top of the target portion 50, it continues to follow the curved contour of the upper portion of the ramp 23, as indicated by the sequential positions 51A and 51B of the ball 51 in FIGS. 2 and 5. The kinetic energy of the ball is gradually dissipated as the ball travels upwardly along the tensioned target portion of the ramp, and sharply reduced as the ball traverses the relatively slack curved upper portion of the ramp.

The remaining kinetic energy of the ball is dissipated when the ball moves from position 51B to position 51C in the loosely hung trough 44 (FIGS. 5 and 6). The slackness of the trough 44 enables it to be distended as required to stop the ball, depending on the kinetic energy remaining in the ball as it moves from position 51B to position 51C. The difference between the distention of the trough 44 in FIG. 5 and the distention of the trough 44 in FIG. 6 is due to the higher speed of the ball as it enters the trough from position 51B in FIG. 5.

Figure 7:
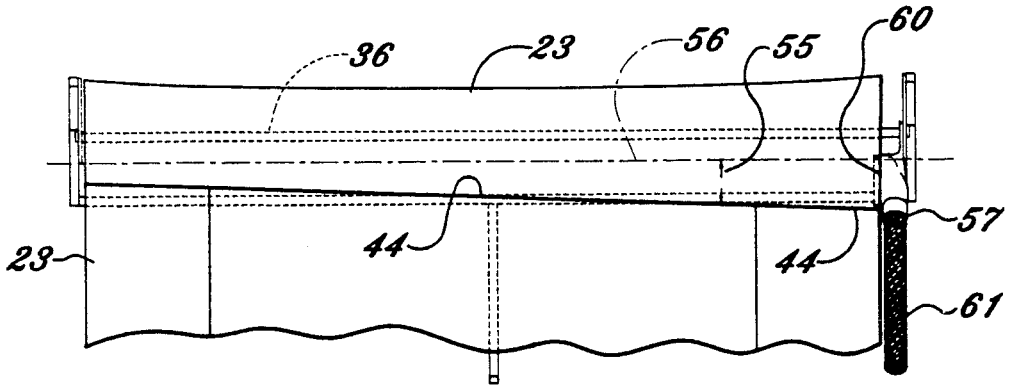
FIG. 7 is a front view of the upper portion of the ramp, with parts broken away, illustrating the laterally sloping trough and its connection with the ball return conduit.

As shown by arrows 55 between the centerline 56 and the trough 44 in FIG. 7, the trough 44 slopes downwardly from left to right in the illustrated embodiment. The lower end 57 of the trough 44 communicates with the entrance 60 of a ball return conduit 61. The conduit 61 is preferably about three inches in diameter and is formed of fabric to minimize the speed of a ball within the conduit and to prevent the ball from bouncing.

The ball return conduit 61 extends downwardly along the right side of the ramp and forwardly from the ramp to the forward end of the safety net 24B in the illustrated embodiment. When the golf practice kit is arranged for a left handed golfer the ball return conduit is moved to the left of the ramp and the trough is rearranged to slope to the left.

Figure 8:
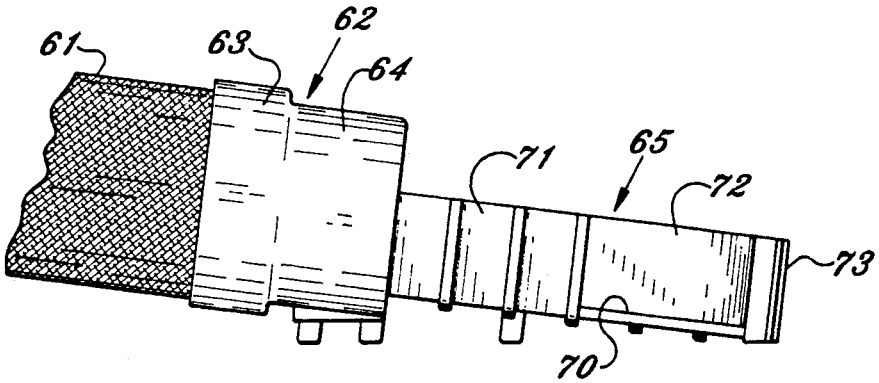
FIG. 8 is an enlarged side view of the ball receptacle at the end of the ball return conduit.
Figure 9:
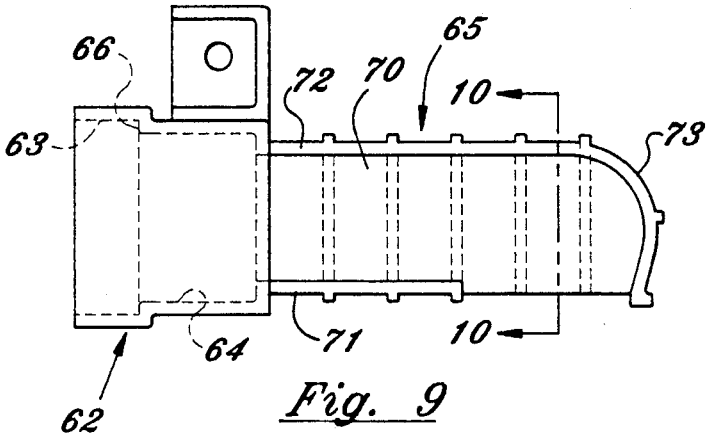
FIG. 9 is a top view of the ball receptacle shown in FIG. 8.
Figure 10:
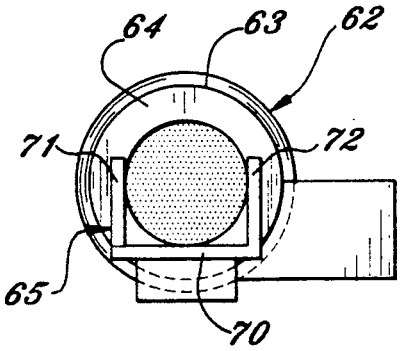
FIG. 10 is a sectional view taken substantially along the line 10—10 in FIG. 9.

The fabric ball return conduit 61 terminates in a hard plastic outlet 62 near the tee area 22. The fabric conduit 61 is attached to the entrance 63 of the outlet 62, and a reduced portion 64 of the outlet 62 is operatively connected to a ball receptacle 65, which is preferably formed integrally with the outlet 62, as shown in FIGS. 8–10.

The internal diameter of the entrance 63 to the outlet 62 is about the same as that of the conduit 61 to insure that balls travelling through the fabric conduit 61 freely enter the outlet 62. The entrance 63 of the outlet 62 is communicatively connected to a reduced portion 64 of the outlet 62, defining an inwardly extending annular shoulder 66 at the juncture of the entrance 63 and reduced portion 64. The internal diameter of the reduced portion 64 is smaller than the internal diameter of the entrance 63, causing each ball that enters the outlet 62 to bounce off of the annular shoulder 66 before entering the reduced portion 64. The impact of the ball against the shoulder 66 reduces the speed of the ball through the reduced portion 64 of the outlet 62.

The speed of the ball is further reduced by a second inwardly turned annular shoulder 67 at the juncture of the outlet 62 with the receptacle 65. The receptacle 65 is an elongated open-topped trough having a U-shaped cross-sectional configuration defined by a bottom wall 70 and opposed side walls 71 and 72 extending forwardly from the reduced portion 64 of the outlet 62. The side walls 71 and 72 of the receptacle are spaced apart a distance less than the internal diameter of the reduced portion 64 of the outlet 62 and only slightly greater than the diameter of the golf balls. The successive shoulders 66 and 67 and the narrow receptacle effectively prevent the balls from undesirably bouncing out of the receptacle.

The wall 72 of the receptacle 65 is shown to extend from the outlet 62 a sufficient distance to accomodate two golf balls. The wall 72 then curves inwardly toward the wall 71 to form a curved end wall 73. The wall 71 of the receptacle 65 is shown to extend from the outlet 62 a shorter distance, sufficient to accomodate only one golf ball. The receptacle 65 may, of course, be extended as desired to accomodate any desired number of balls.

The free end 74 of the shorter wall 71 is spaced from the proximate end 75 of the curved end wall 73 a distance greater than the diameter of a golf ball 51 to provide an opening 76 facing the golfer in FIGS. 1 and 2. The curved end wall 73 directs successive balls toward the opening 76, but the inwardly directed end 75 of the end wall 73 prevents successive balls from leaving the receptacle 65 until the golfer nudges a ball in the opening 76 outwardly toward the golfer, as by using the head of the golf club being used for practice.

There is thus provided a golf practice kit having a structure that provides targets for realistic practice with a variety of clubs; that prevents balls that are hit from contacting metal; that has safety nets to minimize the possibility of errant shots; and that automatically returns successive balls to a predetermined precise location where they are readily available to the user with a minimum of effort.

Although specific terms have been used in describing the invention, they have been used in a generic and descriptive sense only and not for the purpose of limitation, it being intended that the scope of the invention will be determined by a consideration of the appended claims with this specification and with the drawings.

I claim:

1. A golf practice kit comprising:

(a) a frame including upper and lower horizontal frame members, (b) a tee area, (c) a fabric ramp supported in a longitudinally tensioned state by the frame and including:

(i) a target portion extending upwardly and away from the tee area at an angle between the horizontal and the vertical and (ii) a top portion extending above the target portion, (d) the top portion of the ramp being curved inwardly on itself and terminating in a loosely hung through for the reception of successive balls hit against the target portion of the ramp, and (e) the ramp being tensioned by only the upper and lower horizontal frame members, the sides of the ramp being laterally unrestrained.

2. A golf practice kit according to claim 1 wherein the frame is in supporting relation to the ramp, the frame comprising:

(a) a triangular base at the front of the frame, (i) said lower horizontal frame member defining the front of the triangular base, (ii) second and third portions of the triangular base lying in the same plane as the front of the triangular base and (iii) the second and third portions of the triangular base converging at a point spaced rearwardly from the mid portion of the front of the triangular base, (b) a pair of laterally spaced legs spaced rearwardly from the triangular base and extending upwardly toward each other to a point of convergence spaced beneath the ramp and in axial alignment with the point of convergence of the second and third portions of the triangular base, (c) an upwardly and rearwardly inclined frame member extending beneath the ramp and in spaced relation thereto, (i) said upwardly and rearwardly inclined frame member being supported by the triangular base and the pair of legs, (d) a pair of laterally extending top frame members joined to an upper end portion of the upwardly inclined frame member and diverging forwardly therefrom, and (e) means supporting the upper horizontal frame member from the pair of laterally extending top frame members.

3. A golf practice kit according to claim 1 which includes means for maintaining the ramp in spaced relation to the frame during use, whereby balls that are struck against the ramp are prevented from contacting and bouncing off of the frame.

4. A golf practice kit according to claim 3 wherein the portion of the frame that supports the top portion of the ramp comprises generally C-shaped frame members, and wherein elastic straps connect the top portion of the ramp to the generally C-shaped frame members, said elastic straps being arranged to support the top portion of the ramp in a circular configuration, whereby a ball hit from the tee area against the upwardly inclined target portion of the ramp is directed upwardly to the top portion of the ramp, whereby the kinetic energy of the ball is increasingly dissipated as the ball moves up the target portion of the ramp and around the top portion of the ramp to the trough.

5. A golf practice kit according to claim 4 which includes a ball return conduit and wherein the trough slopes laterally and communicates at a lower end with the ball return conduit, whereby successive balls are directed from the trough to the ball return conduit.

6. A golf practice kit according to claim 5 wherein the ball return conduit is formed from fabric.

7. A golf practice kit according to claim 6 wherein the inside diameter of the fabric ball return conduit is about twice the diameter of a golf ball.

8. A golf practice kit according to claim 7 wherein the ball return conduit extends toward the tee area from its juncture with the trough and terminates in a rigid outlet at a point adjacent the tee area.

9. A golf practice kit according to claim 8 wherein a ball receptacle is communicatively connected to the rigid outlet of the fabric ball return conduit.

10. A golf practice kit according to claim 8 wherein the ball receptacle is an open top structure comprising a pair of side walls and an end wall, said side walls extending forwardly from the rigid outlet and being spaced from each other a disdistance only slightly greater than the diameter of a golf ball, one of said side walls extending a greater distance from the rigid outlet than the other side wall, the end wall being joined to said one side wall, said end wall extending transversely of the ball receptacle and terminating in spaced relation to the other side wall to define a side opening, whereby successive balls may be removed from the ball receptacle through the side opening.

11. A golf practice kit according to claim 2 wherein said last named means comprises (a) a pair of generally C-shaped frame portions extending forwardly from opposed ends of the top frame members, and (b) a pair of ears extending downwardly from the free ends of the C-shaped frame portions, the upper horizontal frame member extending between and depending from the pair of ears.

* * * * *